US005923225A

United States Patent [19]

De Los Santos

[11] Patent Number: 5,923,225

[45] Date of Patent: Jul. 13, 1999

[54] NOISE-REDUCTION SYSTEMS AND METHODS USING PHOTONIC BANDGAP CRYSTALS

[76] Inventor: Hector J. De Los Santos, 5228 W. 119th St., Inglewood, Calif. 90304

[21] Appl. No.: 08/943,360

[22] Filed: Oct. 3, 1997

[51] Int. Cl.[6] ..... H01P 1/20

[52] U.S. Cl. ..... 333/12; 330/149; 331/77; 333/202; 333/247

[58] Field of Search ..... 333/12, 202, 246, 333/247, 250; 257/664, 665, 728; 330/149, 308; 331/74, 77, 105

[56] References Cited

U.S. PATENT DOCUMENTS 5,471,180 11/1995 Brommer et al. ..... 333/202
5,717,359 2/1998 Matsui et al. ..... 333/12 X
5,748,057 5/1998 De Los Santos ..... 333/202 X
5,818,309 10/1998 De Los Santos ..... 333/202 X

*Primary Examiner*—Paul Gensler
*Attorney, Agent, or Firm*—Terje Gudmestad; Georgann Grunebach; Michael W. Sales

[57] ABSTRACT

Active electronic circuits are immersed in photonic bandgap crystals (PBC's) that form part of transmission lines for propagation of output signals of the electronic circuits. The output signals of the electronic circuits are accompanied by noise signals that result from spontaneous emission in emission frequency bands which are associated with the active electronic circuits. The PBC's are configured to have photonic bandgaps that include at least a portion of the emission frequency bands. Because the active electronic circuits are immersed in the photonic bandgap crystal, the launch of at least a portion of the noise signals into the transmission line is thereby inhibited. Consequently, the output signal and less than all of the noise signals are propagated along the transmission line, i.e., the noise content of the circuit output is reduced.

21 Claims, 5 Drawing Sheets

NOISE-REDUCTION SYSTEMS AND METHODS USING PHOTONIC BANDGAP CRYSTALS

BACKGROUND OF THE INVENTION

1. Field of the Invention

The present invention relates generally to low-noise electronic systems.

2. Description of the Related Art

Electrical noise is a ubiquitous phenomenon in electronic devices and it typically sets a lower bound on the sensitivity of electronic systems. Electrical noise generally includes thermal noise and shot noise. Thermal noise is generated by random thermal motion of charged particles and is associated with thermodynamic energy exchanges that maintain thermal equilibrium between a circuit and its surroundings. In contrast, shot noise is generated by the random passage of discrete current carriers across barriers or discontinuities (e.g., semiconductor junctions).

Two other noise components originate in low-frequency conductance fluctuations within electrical devices. The first component exhibits a Lorentzian frequency dependence in its power spectral density. It is referred to as G-R noise because it originates from fluctuations in the number of free electrons in device conduction bands that are caused by generation and recombination processes between the bands and interacting traps. The second component exhibits a $1/f^{\alpha}$ ($0.4<\alpha<1.2$) power spectral density. Although its generation is not well understood, a multitude of mechanisms appear to generate it including superposition of G-R spectra with different characteristic times and weights.

The performance of active electronic circuits is degraded by the presence of noise. In a first exemplary degradation, the noise figure of low-noise amplifiers (LNA) is increased. Receiver noise figure is similarly increased because it is primarily determined by the noise figure of the receiver's LNA. Excess noise in LNA's typically manifests itself in device signal fluctuations (e.g., current fluctuations in the gate and drain of field-effect transistors). Oscillator phase noise is increased in a second exemplary degradation. Phase noise in the output signal of oscillators generally results from upconversion of low frequency noise. In a third exemplary degradation, phase noise is added to the output of clock circuits which lowers the performance of systems associated with the clock. For example, phase noise in sampling clocks decreases the dynamic range of analog-to-digital converters.

Conventional methods for reducing noise signals in electronic circuits have generally included the steps of, a) designing electronic device structures with reduced surface area, b) employing materials and processes with favorable carrier generation/recombination parameters and c) selecting active devices that exhibit low excess noise characteristics.

Regardless of the nature of an active device, excess noise is physically associated with statistical processes (e.g., carrier generation and recombination) at various device locations (e.g., surface/passivation interfaces and bulk interfaces such as junctions and heterojunctions). Whatever the specific model adopted to interpret excess noise frequency dependence, conductance fluctuations (which produce measurable voltage fluctuations) are caused by spontaneous emission of atomic carriers. In contrast to stimulated emission which is induced by the presence of radiant energy of like frequency and wavelength, spontaneous emission in a quantum mechanical system is radiation that is emitted when the internal system energy spontaneously drops from an excited state to a lower state without regard to the simultaneous presence of similar radiation.

A reference on spontaneous emission (Yablonovitch, Eli, "Inhibited Spontaneous Emission in Solid-State Physics and Electronics", *The American Physical Society,* Vol. 58, No. 20, May 18, 1987, pp. 2059–2062), points out that it is neither feasible nor desirable to eliminate spontaneous emission entirely if a function of a semiconductor structure (e.g., a laser or a solar cell) is the emission or absorption of light. Rather, the goal in those cases is to restrict spontaneous emission to those electromagnetic modes that are absolutely necessary.

This reference observes that periodic spatial modulation (e.g., in distributed-feedback lasers and interference coatings for wave optics) opens up a forbidden gap in the electromagnetic dispersion relation. For example, three-dimensional spatial periodicity of $\lambda/2$ in the refractive index can result in a forbidden gap in the electromagnetic spectrum near the wavelength $\lambda$. If the electromagnetic band gap overlaps an electronic band edge, then electron-hole radiative recombination (hence, spontaneous emission) will be severely inhibited.

The reference concludes that inhibited spontaneous emission is a real possibility in semiconductor lasers but requires further materials development before the benefits are fully realized. With respect to heterojunction bipolar transistors, the reference teaches minimizing of transistor electron-hole recombination with consequent enhancement of transistor current gain. Because of conflicting requirements (e.g., high base doping to obtain low series resistance and high speed operation), the reference concludes that this application of inhibited spontaneous radiation would be limited to transistors of moderate base doping.

A second reference (Sigalas, M. M., et al., "Metallic Photonic Band-gap Materials", *The American Physical Society,* Vol. 52, No. 16, October 1995, pp. 11744–11751) compares metallic photonic band-gap structures to dielectric photonic bandgap crystals (PBC's). It calculates transmission and absorption characteristics of electromagnetic waves for two-dimensional and three-dimensional periodic structures. In two-dimensional metallic structures, it was determined that propagating modes of s-polarized waves are interrupted by band gaps (behavior similar to that of dielectric PBC's) while p-polarized waves exhibit a cutoff frequency below which propagating modes are severely attenuated. Three-dimensional metallic structures with isolated metallic scatterers were found to behave similar to dielectric PBC's but continuous networks of metallic scatterers were found to have no propagating modes below a cutoff frequency for both s-polarized and p-polarized waves.

A third reference (Sievenpiper, M. M., et al., "3D Wire Mesh Photonic Crystals", *The American Physical Society,* Vol. 76, No. 14, April 1996, pp. 2480–2483) describes three dimensional wire mesh structures having a geometry similar to covalently bonded diamond. Similar to dielectric PBC's, the frequency and wave vector dispersion show forbidden bands at frequencies $\nu_o$ corresponding to the lattice spacing. In addition, they have a forbidden band extending from zero frequency to $\sim\frac{1}{2}\,\nu_o$.

As defined in a fourth reference (Brown, E. R., et al., "Radiation Properties of a Planar Antenna on a Photonic-Crystal Substrate", *Journal of the Optical Society of America,* Vol. 10, No. 2, February 1993, pp. 404–407), a photonic bandgap crystal (PBC) is a periodic structure that exhibits a forbidden band of frequencies (i.e., a photonic bandgap) in its electromagnetic dispersion.

This latter reference introduces PBC's as a substrate material for planar antennas and describes an experimental "bow tie" microstrip antenna that was fabricated by adhering copper tape to surfaces of a PBC. The PBC had a bandgap between 13 and 16 GHz and was fabricated by drilling holes in an epoxy-based dielectric having a dielectric constant of ~13. The radiation performance of this experimental antenna was compared with that of a conventional antenna that was fabricated with a solid substrate of the same dielectric material. Measured radiation patterns of the second antenna indicated that it radiated primarily into its substrate with a lesser, useful radiation into the air. In contrast, measured radiation patterns of the first antenna indicated that its radiation was predominately confined as useful radiation into the air. In a summary of the experimental antenna's performance, it was stated that the PBC substrate expels radiation by Bragg scattering and, consequently, radiation is neither trapped in the substrate nor reflected back at such a phase as to lower the resistance of the antenna's driving point.

Although these references describe various PBC structures and teach the use of a PBC in expelling radiation from a substrate, they fail to provide any guidance to noise-reduction in active circuits (i.e., circuits having components which perform dynamic functions such as amplification, oscillation and signal modification).

SUMMARY OF THE INVENTION

The present invention is directed to noise-reduction structures and methods that have wide-ranging applications. These goals are achieved by using photonic bandgap crystals (PBC's) to inhibit electromagnetic-mode propagation within forbidden regions of the PBC's and immersing active circuits in the PBC's to inhibit launching of noise signals in the forbidden regions.

Output signals at an output port of an active electronic circuit are typically accompanied by noise signals that result from spontaneous emission of electromagnetic radiation in an emission frequency band that is associated with the active electronic circuit. Accordingly, noise reduction is realized by launching the output signal into a transmission line for propagation and by coupling at least the output port portion of the active electronic circuit to a photonic bandgap crystal which has a photonic bandgap that includes at least a portion of the emission frequency band.

Consequently, the launch into the transmission line of at least a portion of the noise signals is inhibited. Thus, the output signal and less than all of the noises signals are propagated along the transmission line, i.e., the signal-to-noise ratio is improved.

Essentially, the coupling step immerses the active electronic circuit in the photonic bandgap crystal. In a first system embodiment, the immersion is achieved by configuring a substrate of a planar transmission line to form a photonic bandgap crystal and coupling the output port to a signal line of this transmission line. In a second system embodiment, the immersion is achieved by establishing a PBC in a waveguide and coupling the output port to the waveguide.

In practicing the teachings of the invention, transmission characteristics of various PBC's (e.g., dielectric and metallic two-dimensional and three-dimensional PBC's) can be selectively matched to correspond to the emission frequency bands of different active electronic circuits.

The novel features of the invention are set forth with particularity in the appended claims. The invention will be best understood from the following description when read in conjunction with the accompanying drawings.

DETAILED DESCRIPTION OF THE PREFERRED EMBODIMENTS

Transmission lines exemplified by microstrip lines, strip lines, slot lines, and coplanar lines are typically referred to as planar transmission lines because their characteristics are determined by dimensions in a single plane. In contrast with coaxial and waveguide transmission lines, the structures of planar transmission lines lend themselves to photolithographic fabrication techniques and facilitate their connection with and integration into electronic circuits.

Figure 1:
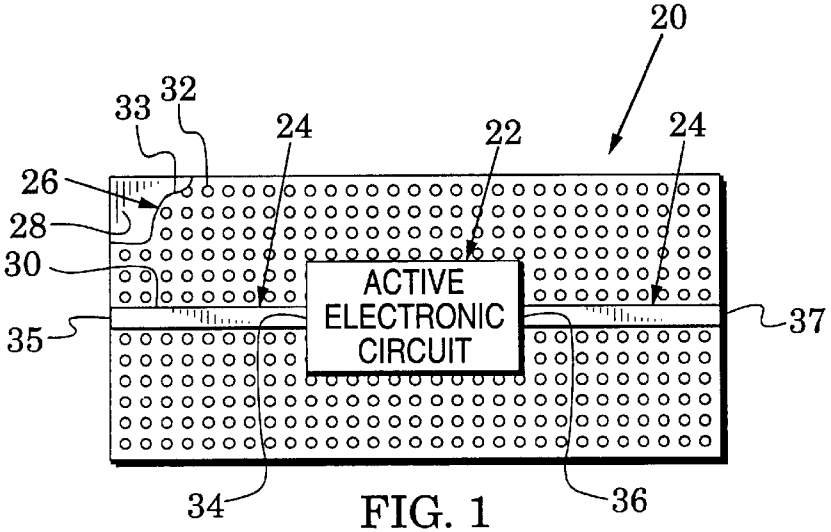
FIG. 1 is a plan view of a low-noise active electronic system of the present invention.

FIG. 1 illustrates a low-noise active electronic system 20 in which an active circuit 22 is associated with a planar transmission line in the form of a microstrip transmission line 24. In FIG. 1, the microstrip transmission line 24 is broken away in one corner to show that it includes a substrate 26, a conductive ground plane 28 and a conductive signal line 30. The ground plane and the signal line are carried on opposed sides of the substrate.

The substrate 26 includes spatially-periodic structures 32 that are defined by a dielectric member 33 (e.g., a ceramic such as alumina or a polymer such as fluorocarbon plastic). In the embodiment of FIG. 1, the structures 32 are holes which are orthogonally arranged with the ground plane 28. The dielectric member 33 and its spatially-periodic structures 32 form a dielectric photonic bandgap crystal (PBC), i.e., the substrate 26 is a dielectric PBC.

The microstrip transmission line 24 conducts output signals of the active circuit 22 away from its output port 34 to a transmission line output 35. Some active electronic circuits may also have a signal input port 36 for reception of input signals from a transmission line input 37. Preferably, interconnections within the active electronic circuit 22 are arranged to also form microstrip structures with the substrate 26 and the ground plane 28.

Figure 2:
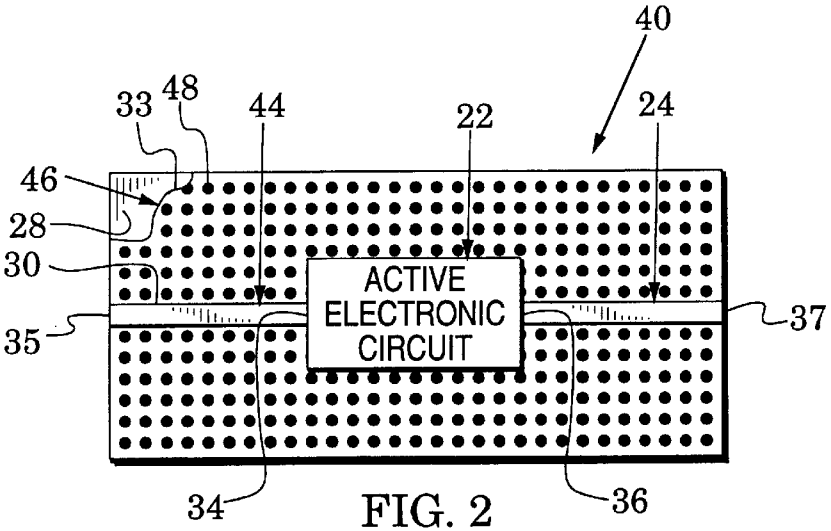
FIG. 2 is a plan view of another low-noise active electronic system.

FIG. 2 illustrates another low-noise active electronic system 40. FIG. 2 is similar to FIG. 1 with like elements indicated by like reference numbers. In the low-noise system 40, however, the planar transmission line 24 of the low-noise system 20 is replaced by a planar transmission line 44. This latter transmission line is similar to the transmission line 24 but has a substrate 46 in which the spatially-periodic structures 32 of the dielectric member 33 of FIG. 1 have been filled with metal (e.g., copper) to form spatially-periodic metallic structures in the form of posts 48. Accordingly, the dielectric member 33 and its spatially-periodic posts form a metallic photonic bandgap crystal (PBC), i.e., the substrate 46 is a metallic PBC.

In operation of the low-noise systems 20 and 40, the active circuit 22 generates output signals which are launched onto the microstrip transmission lines 24 and 44 and propagated to the transmission line output 35. In some active circuits (e.g., oscillators) the output signals are generated without need for any input. In other active circuits (e.g., low-noise amplifiers) the output signals are generated in response to input signals which are conducted from the transmission line input 37 to the input port 36.

The output signals of the active circuit 22 are accompanied by noise signals which result from spontaneous emission of electromagnetic radiation in an emission frequency band that is associated with the active circuit 22. In conventional electronic systems, these noise signals would be launched onto the transmission lines 24 and 44 with the output signals and propagated to the transmission line output 35. Because the noise signals appear with the output signals at the output 35, they degrade the system's performance.

In contrast, the planar transmission lines 24 and 44 of the invention are configured so that they inhibit the launching and subsequent propagation of at least a portion of the noise signals. In particular, the substrates 26 and 46 of the planar transmission lines are configured as PBC's which have forbidden regions in their transmission characteristics. Typically, the transmission-forbidden regions can be positioned to substantially cover the emission frequency band of spontaneous emission that is associated with the active circuit 22 while avoiding the operating frequency of the active circuit.

As signals of the active circuit 22 travel along the microstrip transmission lines 24 and 44, a small portion of their electromagnetic fields extend through the air above the transmission lines but the major portion of these fields is contained within the substrates 26 and 46. Accordingly, the functional processes of the active circuit 22 are substantially immersed within the PBC's that are formed by these substrates. Because of this immersion, the launching of the noise signals into the transmission lines 24 and 44 is inhibited within the PBC forbidden regions.

The forbidden regions are configured to avoid the output signal regions of the active circuit 22. Accordingly, the transmission of the active circuit's output signals is not affected and their electromagnetic modes propagate along the planar transmission lines 24 and 44 to the transmission line output port 35. In comparison to conventional electronic systems, therefore, the signal-to-noise ratio is improved at the output 35.

Figure 3C:
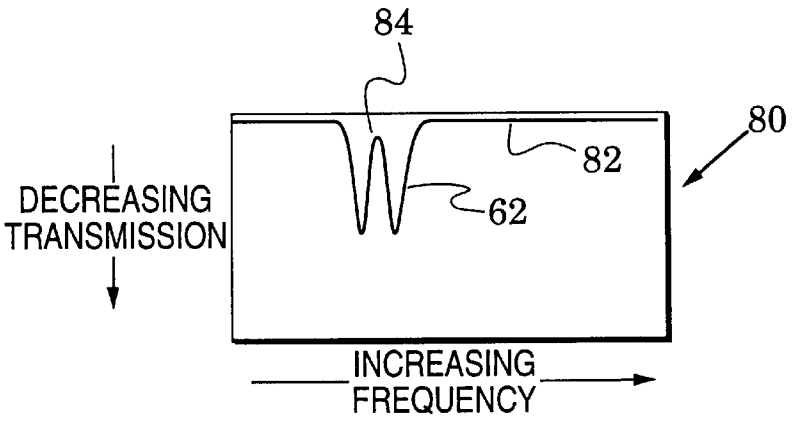
FIGS. 3A–3D are graphs which illustrate transmission characteristics of different photonic bandgap crystals in the systems of FIGS. 1 and 2.
Figure 3D:
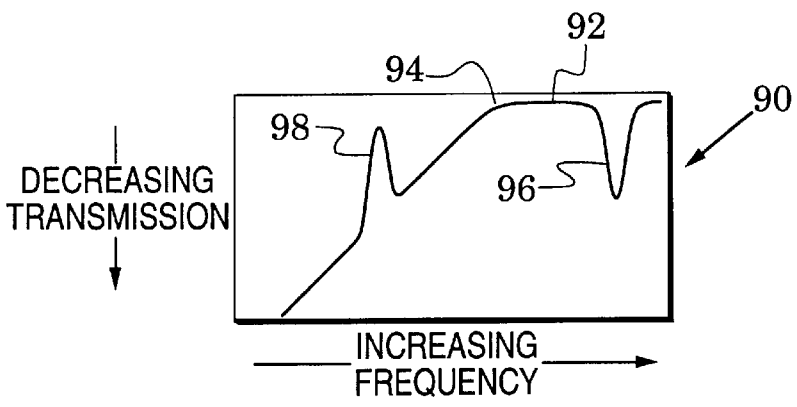
Figure 3A:
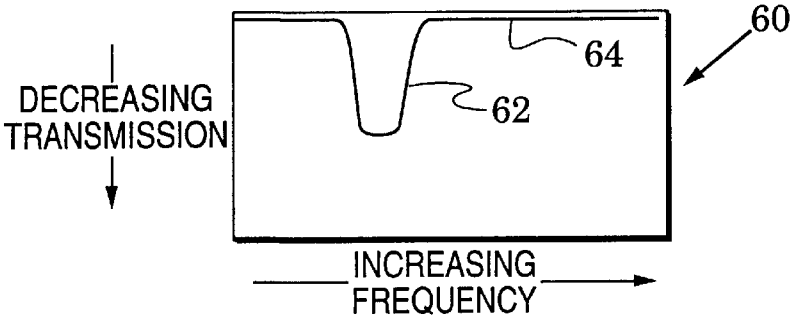
Figure 3B:
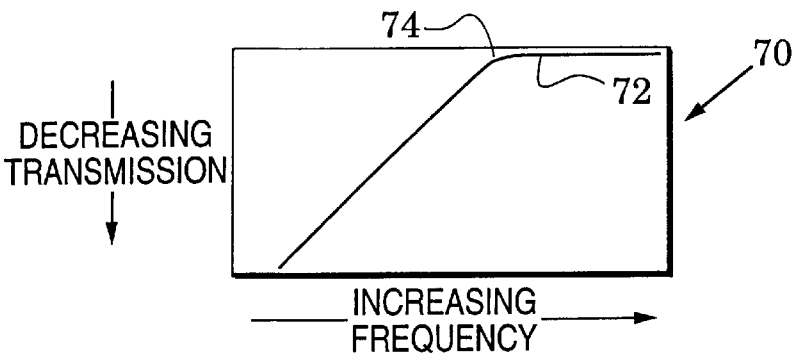

FIGS. 3A–3C illustrate transmission plots of exemplary dielectric and metallic PBC's. A dielectric PBC is one having spatially-periodic dielectric structures (e.g., spatially-periodic holes). A metallic PBC is one having spatially-periodic metallic structures (e.g., spatially-periodic wires or posts).

A variety of different transmission plots can be obtained with combinations of different electromagnetic modes and different dielectric and metallic PBC structures. PBC transmission plots also vary depending on whether the periodic structure of the PBC is two-dimensional (i.e., periodic only in two dimensions) or three-dimensional (i.e., periodic in three dimensions). The plots of FIGS. 3A–3C are only exemplary of those which have been documented in numerous references (e.g., the references recited above in the background section).

In particular, the graph 60 of FIG. 3A shows a rejection band 62 in a transmission plot 64 which is characteristic of both dielectric and metallic PBC's. The graph 70 of FIG. 3B shows a transmission plot 72 which has a cutoff frequency 74 below which transmission is severely attenuated. This high-pass shape is characteristic of many metallic PBC's.

By introducing defects (i.e., discontinuities) in the periodic structure of both dielectric and metallic PBC's, a passband can be introduced within a rejection band. This is exemplified by the transmission plot 82 of the graph 80 of FIG. 3C. This plot is similar to the plot 64 of FIG. 3A but has a passband 84 within the rejection band 62. As shown in the graph 90 of FIG. 3D, three-dimensional metallic PBC's can be configured to have a transmission plot 92 which exhibits both a cutoff frequency 94 and a higher-frequency rejection band 96. In addition, the introduction of defects in the spatially-periodic metallic structure can cause a passband 98 to appear below the cutoff frequency 94.

The spacing of spatially-periodic structures to obtain transmission plots exemplified by those of FIGS. 3A–3D has been well documented in the PBC art. For example, the frequency of the rejection band 96 in FIG. 3D represents a wavelength which substantially corresponds to the periodic spacing while the cutoff frequency 94 represents a wavelength which substantially corresponds to one half of the periodic spacing.

The output signals of active electronic circuits are typically accompanied by noise signals that result from spontaneous emission of electromagnetic radiation in emission frequency bands that are associated with the active electronic circuit. These active electronic circuits can be immersed in transmission lines whose PBC substrates are selected so that their transmission characteristics (as exemplified in FIGS. 3A–3D) have forbidden regions which correspond to the circuits' emission frequency bands.

Figure 4A:
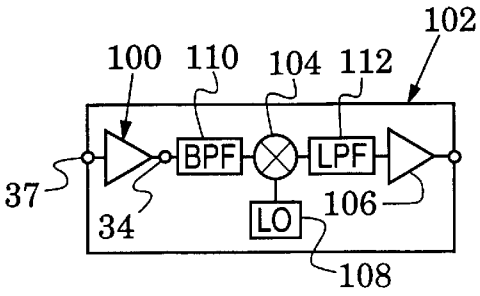
FIGS. 4A–4C are block diagrams of different active electronic circuits in the system of FIG. 1.
Figure 4B:
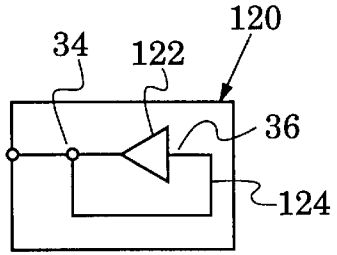
Figure 4C:
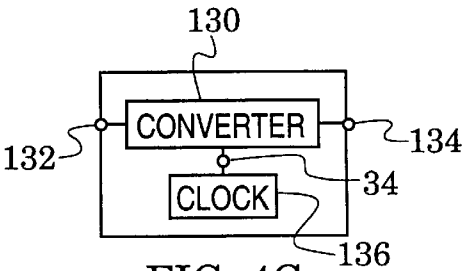

FIGS. 4A–4C illustrate examples of the active electronic circuit 22 of FIGS. 1 and 2. A low-noise amplifier (LNA) 100 is included in a receiver 102 of FIG. 4A for initial amplification of an input signal from the input 37. The output port 34 of FIGS. 1 and 2 is located at the amplifier's output. Subsequently, the amplified signal is downconverted in a mixer 104 for further amplification in an intermediate-frequency amplifier 106. A downconversion signal is supplied to the mixer 104 by a local oscillator (LO) 108. A bandpass filter (BPF) 110 precedes the mixer 104 to reduce spurious input signals while a lowpass filter (LPF) 112 follows the mixer to reduce spurious mixing signals.

As stated above, the LNA 100 primarily determines the noise figure of the receiver 102. A substantial portion of the excess noise of LNA's appears as modulation sidebands about the amplifying frequency. That is, excess noise results from spontaneous emission of electromagnetic radiation in an emission frequency band and the emission frequency band associated with the LNA 100 is the region surrounding the amplified signal. An appropriate corresponding PBC transmission characteristic for the LNA 100 may therefore be the transmission plot 82 shown in FIG. 3C.

Because low-frequency noise is also upconverted to appear in the LNA's output, another emission frequency band associated with the LNA 100 is the region below the amplified signal. Accordingly, another appropriate corresponding PBC transmission characteristic for the LNA 100 may be a modified version of the transmission plot 92 of FIG. 3D. In this case, it would be modified by removing the passband 98 and the defect in the spatially-periodic metallic structure which generated it.

FIG. 4B illustrates an oscillator 120 having an amplifier 122 and a feedback path 124 from the amplifier's output port 34 to its input port 36. A substantial portion of the phase noise of oscillators is determined by upconversion of low-frequency noise. Therefore, an emission frequency band associated with the oscillator 120 lies below the oscillator output frequency. An appropriate corresponding PBC transmission characteristic for the oscillator 120 may therefore be the transmission plot 72 of FIG. 3B.

In FIG. 4C, an analog-to-digital converter (ADC) 130 converts analog signals at an analog input 132 to digital signals at a digital output 134. This conversion is accomplished with the timing supplied by a sampling clock 136. Noise at the clock's output port 34 degrades the dynamic range of the ADC. Because the emission frequency bands associated with the clock 136 are similar to those of the oscillator 120 of FIG. 4B, appropriate corresponding PBC transmission characteristics may also be that of FIG. 3B.

Figure 5A:
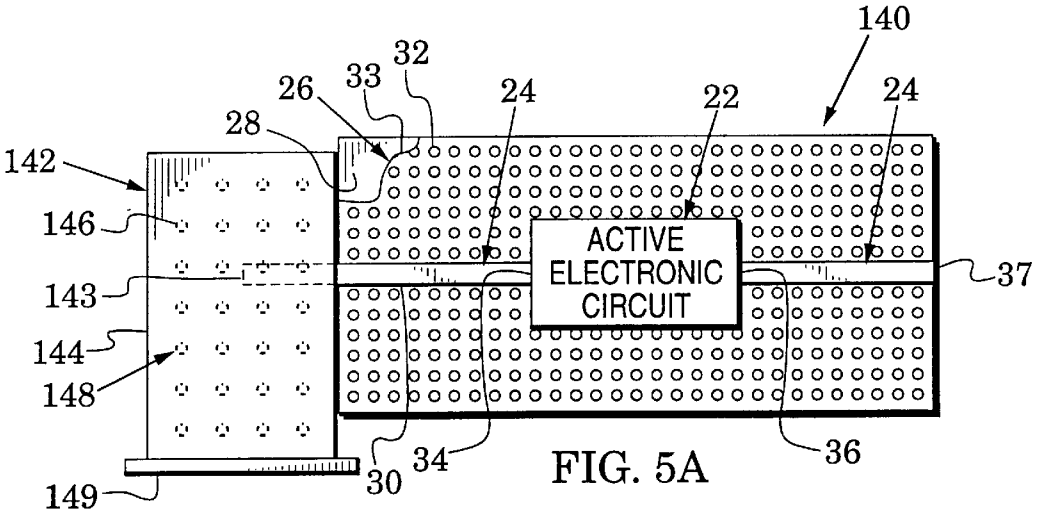
FIGS. 5A and 5B are plan and elevation views of another low-noise active electronic system.
Figure 5B:
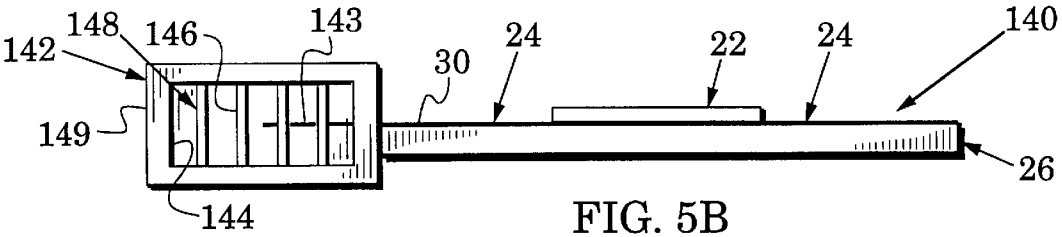

The teachings of the invention can be extended to transmission lines other than planar transmission lines. For example, FIGS. 5A and 5B are similar to FIG. 1 (with like elements indicated by like reference numbers) except that the output port 34 has been adapted to couple signals into a waveguide transmission line 142. In an active electronic system 140, the signal line 30 of the planar transmission line 24 has been extended as a probe 143 which couples to electromagnetic propagation modes in a waveguide 144. Metal posts 146 are arranged in a lattice to form a PBC 148. The output of the waveguide transmission line is at a waveguide end which carries an attachment flange 149.

Although the illustrative PBC 148 has a two-dimensional spatially-periodic metallic structure, the waveguide 144 can alternatively be configured with three-dimensional structures (e.g., a three-dimensional wire mesh). The PBC 148 would typically be configured to have a transmission characteristic (e.g., one of the transmission plots of FIGS. 3A–3D) which is selected to conform to the noise emission frequency band of its active electronic circuit 22.

Figure 6A:
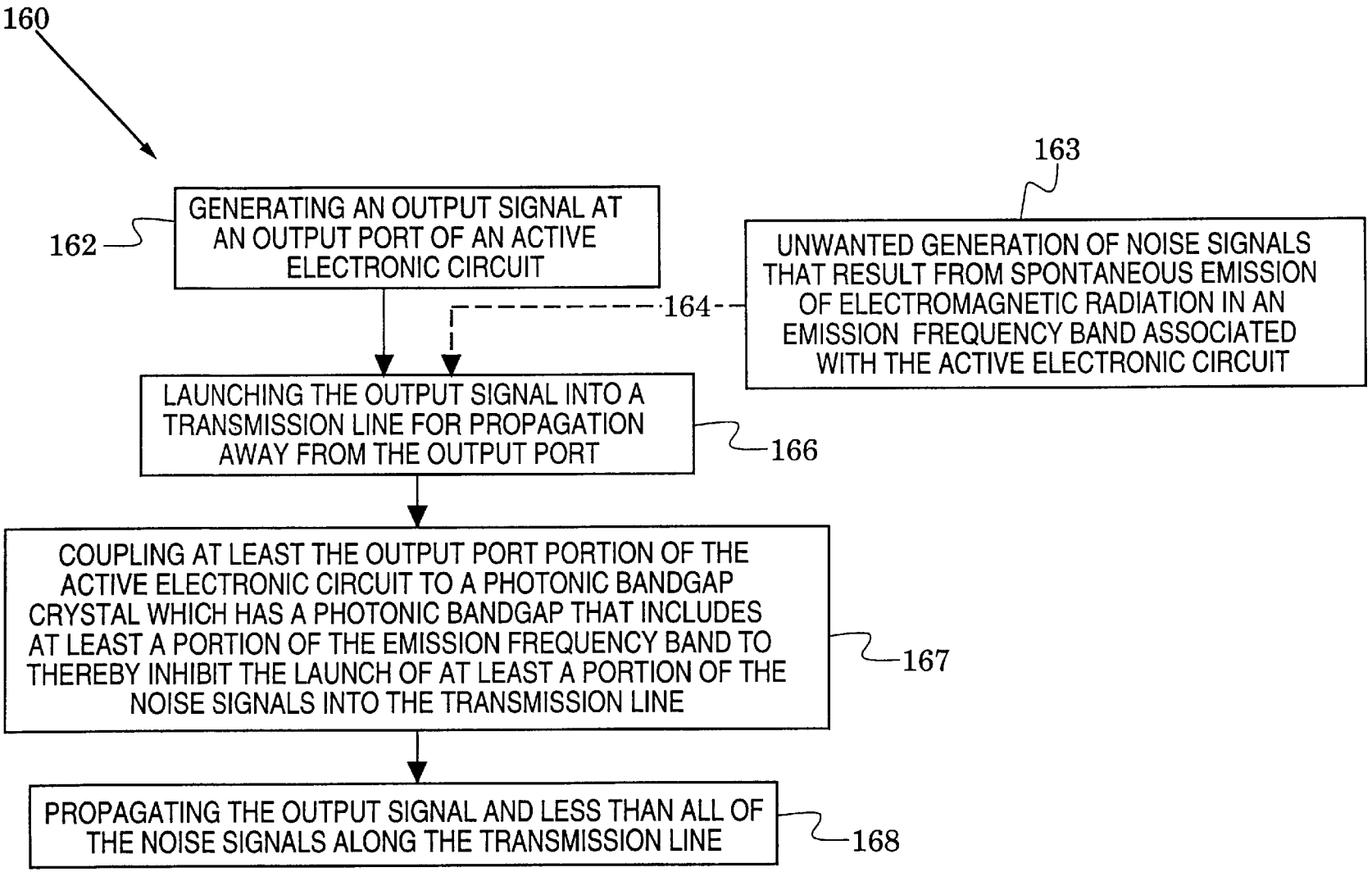
FIGS. 6A–6C are flow charts which illustrate noise-reduction processes in the low-noise active electronic systems of FIGS. 1, 4, 5A and 5B.
Figure 6C:
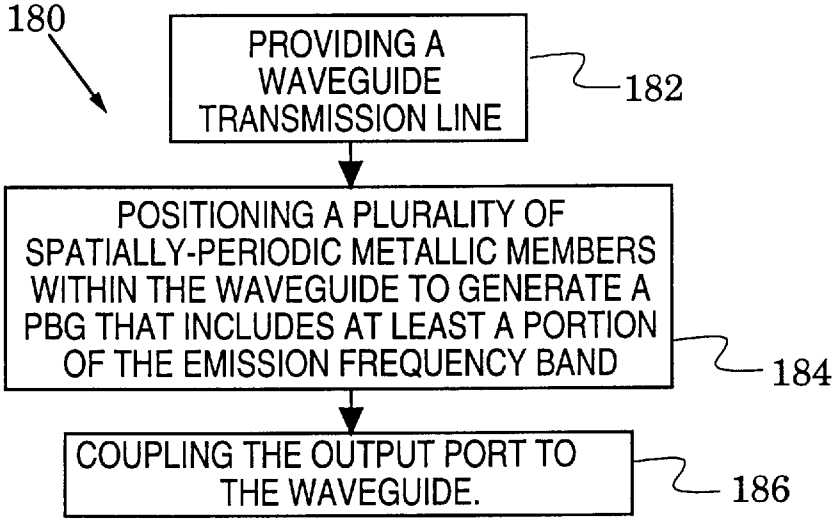
Figure 6B:
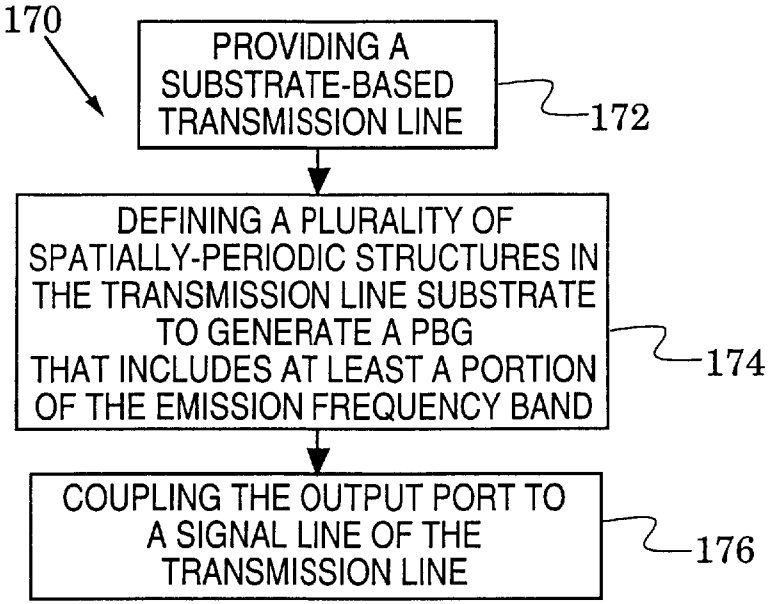

FIGS. 6A–6C illustrate noise-reduction processes in the low-noise active electronic systems of FIGS. 1, 2, 5A and 5B. In particular, FIG. 6A shows a process 160 which has a first process step 162 in which an output signal is generated at an output port of an active electronic circuit. Unfortunately, this output signal is accompanied by the unwanted contribution of noise signals. That is, a process 163 is not an intended process but is, instead, an unwanted process that results from spontaneous emission in an emission frequency band that is associated with the active electronic circuit. The broken connection line 164 indicates that step 163 is an involuntary step.

In step 166, the output signal is launched into a transmission line for propagation away from the electronic circuit's output port. In step 167, at least the output port portion of the active electronic circuit is coupled to a photonic bandgap crystal which has a photonic bandgap that includes at least a portion of the emission frequency band. Because at least a portion of the active electronic circuit is thereby immersed in the photonic bandgap crystal, the launch of at least a portion of the noise signals into the transmission line is inhibited. Therefore, the output signal and less than all of the noise signals are propagated along the transmission line in process step 168.

The coupling process of step 167 immerses the electronic circuit in a photonic bandgap crystal. In detail, this action is initiated in flow chart 170 by providing a substrate-based transmission line (e.g., a planar transmission line) in step 172. In step 174, a plurality of spatially-periodic structures are formed in a substrate of the transmission line to generate a photonic bandgap (PBG) that includes at least a portion of the emission frequency band (recited in step 167 of FIG. 6A). Finally, the electronic circuit is immersed in the photonic bandgap crystal by coupling its output port in step 176 to a signal line of the transmission line. Preferably, a substantial portion of the electronic circuit is also carried by other signal lines of the transmission line.

Another immersion process is detailed in the flow chart 180 of FIG. 6C. This process is initiated in step 182 by providing a waveguide transmission line. In step 184, a plurality of spatially-periodic metallic members are positioned within the waveguide to generate a photonic bandgap (PBG) that includes at least a portion of the emission frequency band. Finally, the electronic circuit is immersed in the photonic bandgap crystal by coupling its output port in step 186 to the waveguide.

Although the teachings of the invention have been illustrated with reference to two-dimensional PBC's, they may be practiced also with three-dimensional PBC's. Although the active electronic circuit 22 of FIGS. 5A and 5B has been shown to be coupled into the waveguide transmission line 142 via a planar transmission line 24, other embodiments of the invention can be formed in which the active circuit and the waveguide transmission line are directly coupled.

While several illustrative embodiments of the invention have been shown and described, numerous variations and alternate embodiments will occur to those skilled in the art. Such variations and alternate embodiments are contemplated, and can be made without departing from the spirit and scope of the invention as defined in the appended claims.

I claim:

1. A low-noise active electronic system, comprising:

an active electronic circuit having an output port and generating an output signal at said output port which is accompanied by noise signals that are generated by spontaneous emission of electromagnetic radiation in an emission frequency band associated with said active electronic circuit;

a planar transmission line coupled to said output port to receive and propagate said output signal wherein said planar transmission line includes:

a) a substrate with said active electronic circuit positioned over said substrate and supported by said substrate;

b) a signal line carried by said substrate and coupled to said output port; and c) a ground plane carried by said substrate and spaced from said signal line;

and a photonic bandgap crystal coupled to said output port, said photonic bandgap crystal formed by spatially-periodic structures in said substrate that are configured to have a photonic bandgap which includes at least a portion of said emission frequency band so that launching of at least a portion of said noise signals onto said transmission line is inhibited, said transmission line thereby propagating said output signal and less than all of said noise signals.

2. The low-noise active electronic system of claim 1, wherein said active electronic circuit is carried on said substrate.

3. The low-noise active electronic system of claim 1, wherein said substrate is comprised of a ceramic.

4. The low-noise active electronic system of claim 1, wherein said substrate is comprised of a fluorocarbon polymer.

5. The low-noise active electronic system of claim 1, wherein said spatially-periodic structures are holes formed by said substrate.

6. The low-noise active electronic system of claim 1, wherein said spatially-periodic structures are metal posts.

7. The low-noise active electronic system of claim 1, wherein said spatially-periodic structures have two-dimensional periodicity.

8. The low-noise active electronic system of claim 1, wherein said spatially-periodic structures have three-dimensional periodicity.

9. The low-noise active electronic system of claim 1, wherein said transmission line is a microstrip transmission line.

10. The low-noise active electronic system of claim 1, wherein said active electronic circuit includes a low-noise amplifier coupled to said output port.

11. The low-noise active electronic system of claim 1, wherein said active electronic circuit includes an oscillator coupled to said output port.

12. The low-noise active electronic system of claim 1, wherein said active electronic circuit includes a clock coupled to said output port.

13. A low-noise active electronic system, comprising:

an active electronic circuit having an output port and generating an output signal at said output port which is accompanied by noise signals that are generated by spontaneous emission of electromagnetic radiation in an emission frequency band associated with said active electronic circuit;

a transmission line coupled to said output port to receive and propagate said output signal; and a photonic bandgap crystal coupled to said output port and configured to have a photonic bandgap which includes at least a portion of said emission frequency band so that launching of at least a portion of said noise signals onto said transmission line is inhibited, said transmission line thereby propagating said output signal and less than all of said noise signals;

wherein at least a portion of said transmission line is a waveguide and said photonic bandgap crystal comprises a plurality of spatially-periodic metallic members positioned within said waveguide.

14. The low-noise active electronic system of claim 13, wherein said metallic members are metallic posts.

15. The low-noise active electronic system of claim 13, wherein said spatially-periodic metallic members have two-dimensional periodicity.

16. The low-noise active electronic system of claim 13, wherein said spatially-periodic metallic members have three-dimensional periodicity.

17. A low-noise active electronic system, comprising:

an active electronic circuit having an output port and generating an output signal at said output port which is accompanied by noise signals that are generated by spontaneous emission of electromagnetic radiation in an emission frequency band associated with said active electronic circuit;

a transmission line coupled to said output port to receive and propagate said output signal; and a photonic bandgap crystal coupled to said output port and configured to have a photonic bandgap which includes at least a portion of said emission frequency band so that launching of at least a portion of said noise signals onto said transmission line is inhibited, said transmission line thereby propagating said output signal and less than all of said noise signals;

wherein:

said transmission line includes first and second coupled transmission line portions:

said first transmission line portion has:

a) a substrate;

b) a signal line carried by said substrate and coupled to said output port; and c) a ground plane carried by said substrate and spaced from said signal line; and said second transmission line portion is a waveguide; and said photonic bandgap crystal includes a first photonic bandgap crystal portion formed by spatially-periodic structures in said substrate, and a second photonic bandgap crystal portion formed by spatially-periodic metallic members in said waveguide.

18. The low-noise active electronic system of claim 17, wherein said signal line extends into said waveguide to couple said first and second transmission line portions.

19. A method of reducing noise signals in an output signal of an active electronic circuit, comprising the steps of:

generating an output signal at an output port of an active electronic circuit wherein said output signal is accompanied by noise signals that are generated by spontaneous emission of electromagnetic radiation in an emission frequency band associated with said active electronic circuit;

launching said output signal into a transmission line for propagation away from said output port; and coupling at least the output port portion of said active electronic circuit to a photonic bandgap crystal which has a photonic bandgap that includes at least a portion of said emission frequency band to thereby inhibit the launch of at least a portion of said noise signals into said transmission line, said output signal and less than all of said noise signals thereby propagated through said transmission line;

wherein said coupling step includes the steps of:

providing a waveguide as said transmission line;

positioning a plurality of spatially-periodic metallic members within said waveguide to form said photonic bandgap crystal; and coupling said output port to said waveguide.

20. A method of reducing noise signals in an output signal of an active electronic circuit wherein said output signal is accompanied by noise signals that result from spontaneous emission of electromagnetic radiation in an emission frequency band associated with said active electronic circuit, said method comprising the steps of;

positioning said active electronic circuit over a planar transmission line so that it is supported by said planar transmission line;

launching said output signal into said planar transmission line for propagation away from said output port;

defining a plurality of spatially-periodic structures in a substrate of said planar transmission line to thereby form a photonic bandgap crystal with a photonic bandgap that includes at least a portion of said emission frequency band; and coupling at least the output port portion of said active electronic circuit to said photonic bandgap crystal to thereby inhibit the launch of at least a portion of said noise signals into said transmission line, said output signal and less than all of said noise signals thereby propagated through said transmission line.

21. A method of reducing noise signals in an output signal of an active electronic circuit wherein said output signal is accompanied by noise signals that result from spontaneous emission of electromagnetic radiation in an emission frequency band associated with said active electronic circuit, said method comprising the steps of;

launching said output signal into a transmission line for propagation away from said output port; and coupling at least the output port portion of said active electronic circuit to a photonic bandgap crystal which has a photonic bandgap that includes at least a portion of said emission frequency band to thereby inhibit the launch of at least a portion of said noise signals into said transmission line, said output signal and less than all of said noise signals thereby propagated through said transmission line;

wherein said coupling step includes the steps of:

providing a waveguide as said transmission line;

positioning a plurality of spatially-periodic metallic members within said waveguide to form said photonic bandgap crystal; and coupling said output port to said waveguide.

* * * * *